United States Patent [19]

Gontero

[11] 4,057,343

[45] Nov. 8, 1977

[54] ELECTROSTATIC COPYING MACHINE WITH MULTI-FRAME DRUM ASSEMBLY

[75] Inventor: Piero Gontero, Bollengo (Turin), Italy

[73] Assignee: Ing. C. Olivetti & C., S.p.A., Italy

[21] Appl. No.: 730,565

[22] Filed: Oct. 7, 1976

[30] Foreign Application Priority Data

Oct. 9, 1975 Italy ..... 69515/75

[51] Int. Cl.[2] ..... G03G 15/00

[52] U.S. Cl. ..... 355/16

[58] Field of Search ..... 355/16, 3 BE, 3 R, 133

[56] References Cited

U.S. PATENT DOCUMENTS 3,887,278 6/1975 Kolibas ..... 355/16

OTHER PUBLICATIONS

"Xerographic Drum", by R. A. Berlier et al., IBM Tech. Bull., vol. 15, No. 4, Sept. 1972, p. 1261.

*Primary Examiner*—Richard L. Moses
*Attorney, Agent, or Firm*—W. R. Hulbert

[57] ABSTRACT

An electrophotographic copying machine in which the drum is rotatable about a given axis and is at least partly formed by a plurality of sectors each having a surface constituting part of the cylindrical periphery of the drum and each being mounted within the drum as to be slidable in a direction perpendicular to the said axis between a first position in which it defines the respective part of the cylindrical periphery of the drum, and a second position into which it is shifted radially with respect to the remainder of the cylindrical periphery; each of the sectors has a portion of a photoconductive band wound around its surface and extending from a feed reel to a take-up reel; these reels are mounted inside the respective sector and reversible locking means are provided for maintaining the sectors in their first position during the rotation of the drum about the said axis.

8 Claims, 6 Drawing Figures

ELECTROSTATIC COPYING MACHINE WITH MULTI-FRAME DRUM ASSEMBLY

BACKGROUND OF THE INVENTION

The present invention relates to a copying machine of the type having a drum bearing a sheet of photosensitive material wound around its surface for the purpose of carrying this sheet through successive stages of copying at stations disposed around and adjacent the periphery of the drum.

A machine of the aforesaid type is known in which this sheet is constituted by a portion of a band or strip fed from a feed reel and rewound on a take-up reel, both reels being mounted inside the drum which is provided with two slots in its periphery for the purpose of permitting the said band to emerge from the interior of the drum and re-enter it. The band is wound around a first portion of the drum having an angular extent of about 180°, while a second portion complementary to this first portion and not covered by any band is pivoted in the covered portion so as to form a cover which can be opened for gaining access to the interior of the drum.

This copying machine, however, has the disadvantage that in order to replace the reels it is necessary to remove either the entire drum from the machine or the greater part of the stations which are mounted adjacent the drum, since otherwise the operation of winding the first portion of photosensitive band around the first porton of the periphery becomes extremely difficult because of the relative obstacle which the drum and the electrophotographic stations form.

The technical problem that the invention proposes to solve is, therefore, that of producing a copying machine of the aforesaid type in which the operation of replacing the feed and take-up reels of the band is facilitated and can take place without the removal of the drum from the machine and in any case with a limited removal of parts of the said machine.

SUMMARY OF THE INVENTION

According to the invention, there is provided an electrophotographic copying machine including an electrophotographic drum rotatable about a given axis, the said drum being at least partly formed by a plurality of sectors each having a surface constituting part of the cylindrical periphery of the drum and each being mounted within the drum as to be slidable in a direction perpendicular to the said axis between a first position in which it defines the respective part of the cylindrical periphery of the drum, and a second position into which it is shifted radially with respect to the remainder of the cylindrical periphery, each of the said sectors having a portion of a photoconductive band wound around its said surface and extending from a feed reel to a take-up reel, the said reels being mounted inside the respective sector, and reversible locking means being provided for maintaining the said sectors in their said first position during the rotation of the drum about the said axis.

BRIEF DESCRIPTION OF THE DRAWINGS

These characteristics and other characteristics of the present invention will become clear from the following description given by way of example, with reference to the accompanying drawings, in which.

DESCRIPTION OF THE PREFERRED EMBODIMENT

Figure 1:
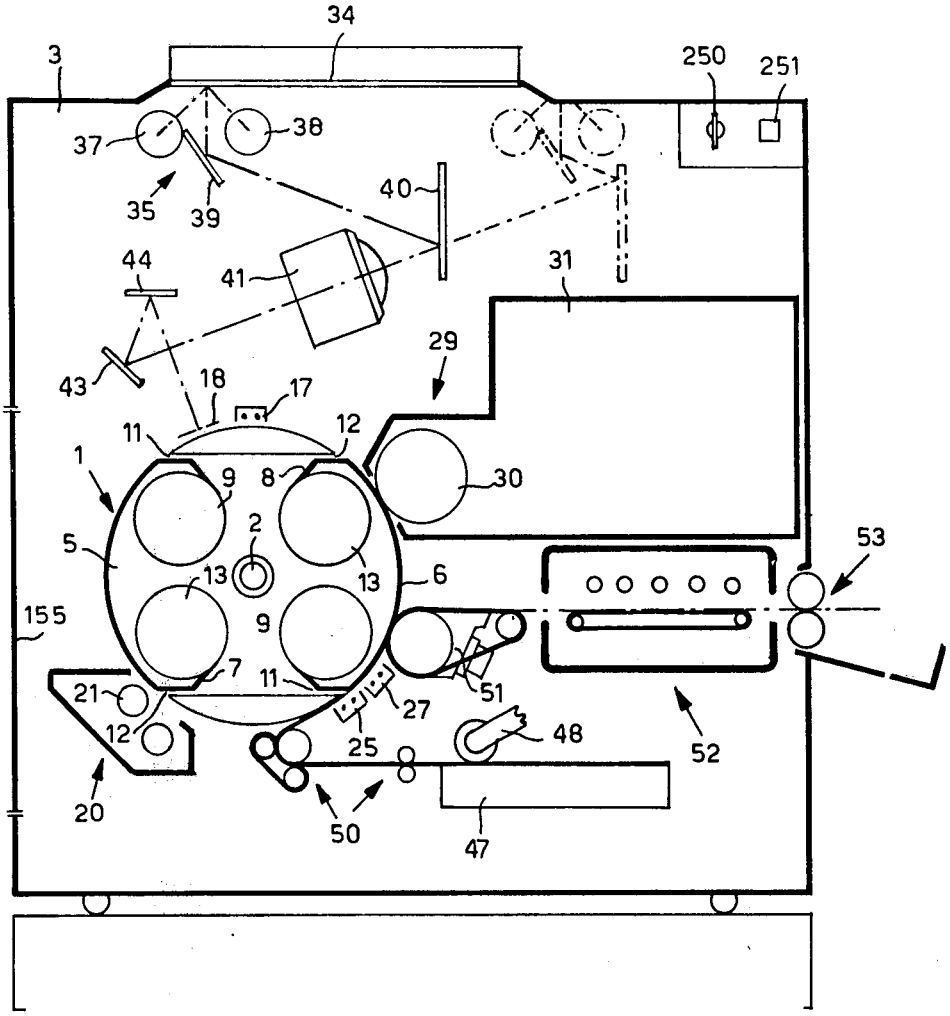
FIG. 1 is a diagrammatic view of an embodiment of an electrophotographic copier according to the invention.
Figure 2:
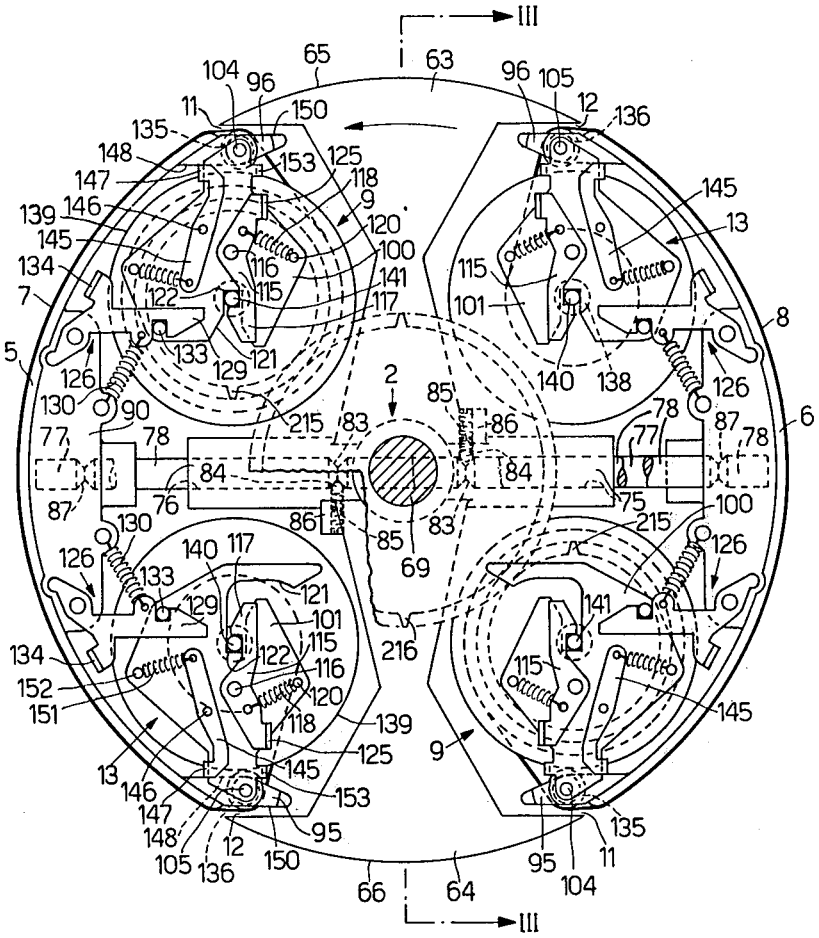
FIG. 2 is a front view, partly in section, of the drum used in the embodiment of FIG. 1.

Referring to FIGS. 1 and 2, the copying machine according to the invention comprises an electrophotographic drum 1 pivoted by means of a hub 2 to the frame of the machine indicated generally by the reference 3.

Around the periphery of the drum 1 and adjacent thereto there are disposed various devices constituting the stations typical of the electrophotographic copying process.

These are: a corona-effect charging station 17, an exposure station 18, a developing station 20 comprising a magnetic developing brush 21, a transfer station comprising a transfer corona charger 25, a copy sheet detaching station comprising an alternating-current corona charger 27, and a cleaning station 29 for the photosensitive band comprising a rotating brush 30 and an aspirator 31.

The drum 1 comprises two diametrically opposed sectors 5 and 6 around which are wound portions of two bands 7 and 8, respectivey, of photoconductive material which are both fed from feed reels 9 mounted inside the drum 1 and emerge on the outer surface of the drum through slots 11 and re-enter the interior of the drum 1 through slots 12 to be wound on take-up reels 13 also mounted inside the drum 1.

The copying machine of FIG. 1 moreover comprises: an illumination surface 34 for the originals to be reproduced; an optical and illumination system 35 comprising two lamps 37 and 38 and a first system of mirrors 39 and 40 movable, in synchronism with the rotation of the drum 1, parallel to the illumination surface 34 to effect the scanning of successive portions of the original placed on the surface 34; a lens 41 and a second system of mirrors 43 and 44 which are fixed and adapted to transmit the image of successive portions of the original placed on the surface 34 and obtained by scanning onto successive portions of the photoconductive bands at the exposure station 18; a container for sheets of ordinary paper 47; means 48 for feeding these sheets one by one to a first conveying system 50 which transports them to the transfer station 25; a second conveying system 51 which conveys the sheet after the transfer to a unit 52 for fixing the toner on the copy sheet; and a third conveyor 53 disposed between the fixing unit and the exit from the machine.

As is well known from the electrophotographic copying process, during the rotation of the drum 1 each of the photoconductive portions of the bands 7 and 8 is charged electrostatically at the charging station 17 and is exposed to the image of the original at the exposure station 18, so that a latent image consisting of electrostatic charges is formed on the said portion. The latent image is then rendered visible at the developing station 20 by the application of electroscopic colour particles through the medium of the magnetic brush 21, after which it is transferred at the transfer station 25 to a sheet of ordinary paper and fixed thereon in the fixing unit 52. This sheet is finally delivered at the exit and constitutes a finished copy of the original, while at the same time the copying cycle concludes with the cleaning of the photosensitive band effected by the brush 30.

This cycle can be repeated a good many tens of times with the same photoconductive portions of the bands 7 and 8, after which these portions must be changed by unwinding a fresh portion of the bands 7 and 8 from the reels 9 and at the same time rewinding the used portions on the take-up reels 13.

The scanning movement of the optical system 35 is linked with the rotation of the drum 1 in such manner that for each complete revolution of the drum there are obtained two scanning travels of the optical system, so that both the matrices are exposed during each complete revolution of the drum. Thus, the other stations are also activated twice during a revolution of the drum, so that during a printing of copies of the same original two copies of this original are made for each revolution of the drum 1.

Since the devices controlling and timing the activaton of the various stations are known in the art, further details of the same will not be described here.

Figure 3:
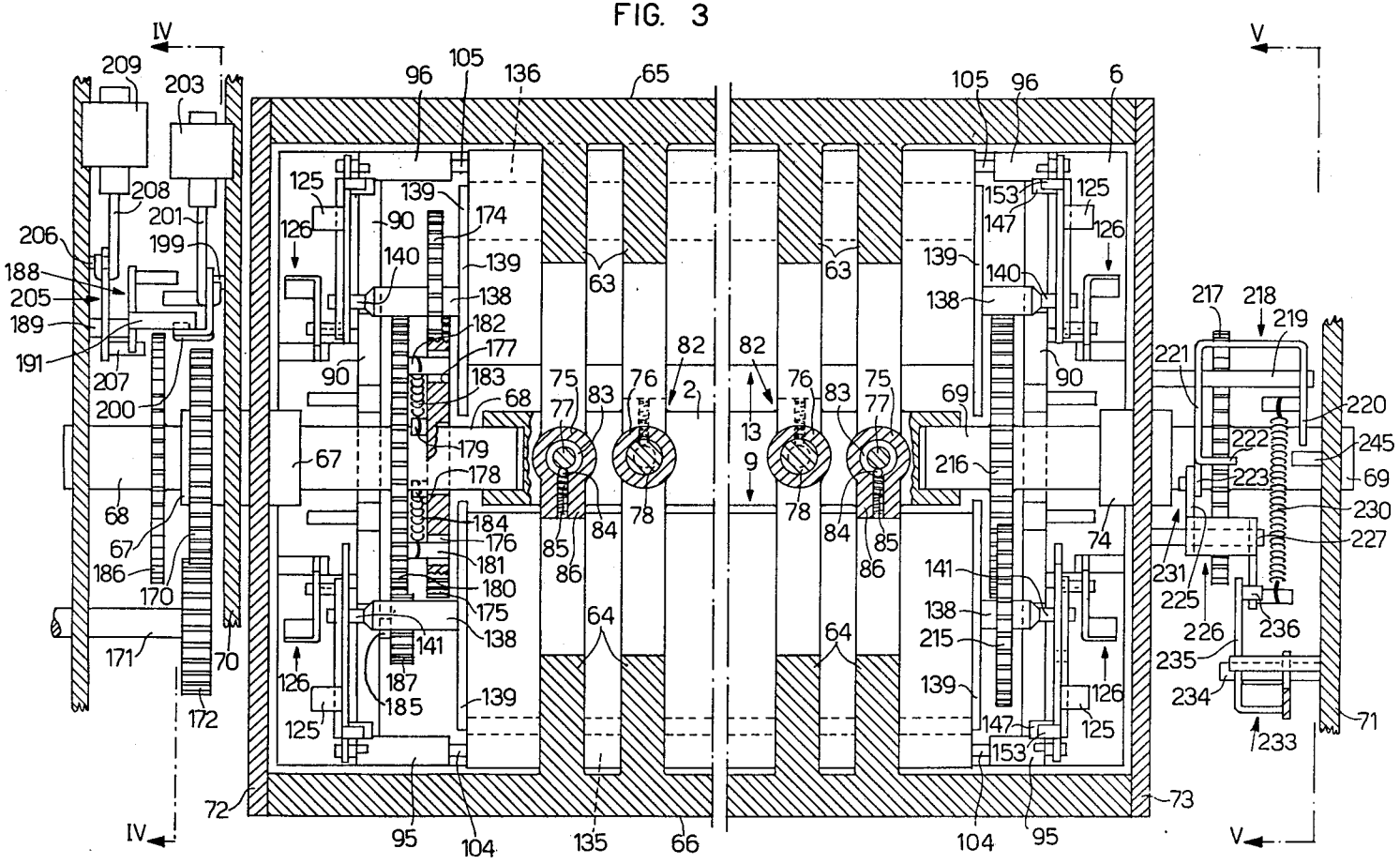
FIG. 3 is a longitudinal section on the line III—III of the drum of FIG. 2.
Figure 6:
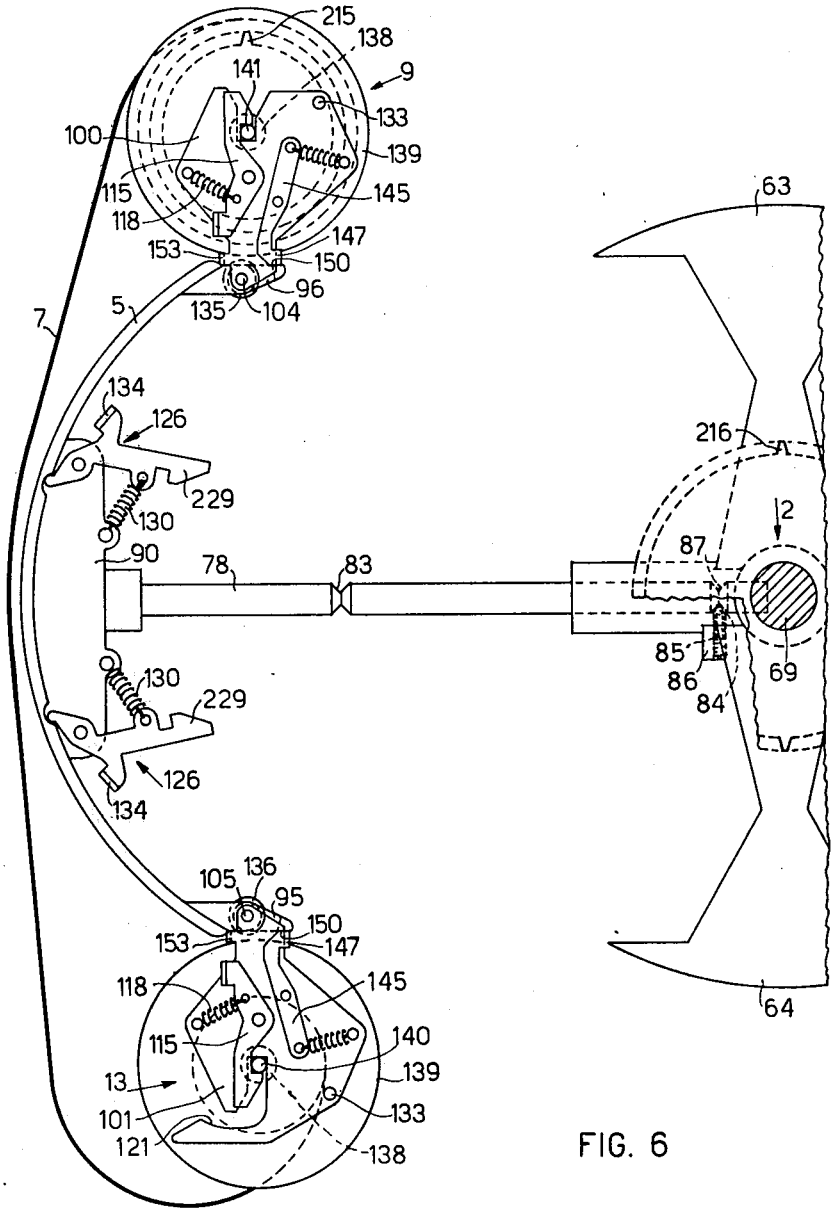
FIG. 6 is a partial front view of the drum of FIG. 2 with the sector 5 in the withdrawn position.

The structure of the drum 1 according to the invention is shown in greater detail in FIGS. 2, 3 and 6.

This structure comprises a hub 2 (FIG. 20 with which spokes 63 and 64 are integral, the spokes having integral with their ends two diametrically opposed sectors 65 and 66, respectivey, of the periphery of the drum.

The hub 2 is mounted rotatably on spindles 68 and 69 mounted rotatably in turn in the side walls 70 and 71 of the body 3 of the machine (FIG. 3).

The side walls 72 and 73 of the drum 1, which are provided with bushes 67 and 74, respectively, through which the spindles 68 and 69 extend, are moreover fast with the sectors 65 and 66.

The hub 2 is provided with two pairs of bushes 75 and 76, respectively, extending in a direction perpendicular to the axis of the drum and to the diametral direction of the spokes 63 and 64. The pairs of pins 77 and 78 can slide through the pairs of bushes 75 and 76. Each of the peripheral sectors 5 and 6 of the drum complementary to the sectors 65 and 66, respectivey, and having a angular extent of about 120' is fast with one end of a respective pair of the pins 77 and 78.

In the operative state, the two sectors 5 and 6 are adjacent the sectors 65 and 66 to define the cylindrical periphery of the drum 1, with the slots 11, 12 defined by the gaps existing between each fixed sector 65, 66 and each movable sector 5 and 6. Each of the sectors 5 and 6 is retained in this position by a reversible locking device 82 (FIGS. 2, 3) comprising a groove 83 formed in the corresponding pins 77, 78, a ball 84 and a spring 85 the seat of which is formed in a cavity 86 of the hub 2 and adapted to urge the ball 84 to co-operate with the groove 83.

For the purpose of changing the bands 7 and 8, on the other hand, each of the sectors 5 and 6 can be moved away from the sectors 65 and 66 integral with the hub by sliding of the pairs of guide pins 77 and 78 in the holes 75 and 76, respectively, until the withdrawn position of FIG. 6 is reached. A groove 87 formed at the free end of each of the pins 77 and 78 can engage with the ball 84 of the locking device 82 to limit the travel and prevent the pins 77 and 78 leaving the respective bushes 75 and 76. As will be described better hereinafter, each of the sectors 5 and 6 comprises suitably shaped reinforcements 90 in the proximity of its two lateral ends and inside it, each having at the angular ends of the sector projections 95 and 96 which extend inside the cylinder 1 in a directon parallel to the pins 77 and 78.

Two guide rollers 135 and 136 for the bands 7, 8 are keyed on pins 104 and 105 mounted rotatably at opposite ends on the pairs of projections 95 and 96 of each sector 5 and 6.

The rollers 135 and 136 have axes parallel to the axis of the drum 1.

The reels 9 and 13 mounted on each sector 5 and 6 each comprise a cylindrical core 138 (FIGS. 2, 3) with a side wall 139 and integral with pins 141 and 140, respectivey. The pins 141 and 140 are supported rotatably at the opposite ends on the pairs of side plates 100 and 101, respectively, pivoted on the pins 104 and 105, respectively, adjacent the projections 95 and 96. Each of the side plates 100 and 101 comprises a recess 121 adapted to accommodate one end of the pins 141, 140 respectively, which it is intended to support.

A lever 115 is pivoted to each side plate 100, 101 on a pin 116 fast with the latter and is provided at one end with a tooth 117 adapted to co-operate, by the action of a spring 118 stretched between the lever 115 and a fixed point 120 of the side plate, with the shoulder 122 of the recess 121 provided in each side plate to retain the corresponding pin 140, 141. Each lever 115 is provided with a lug 125 at the opposite end.

Each of the side plates 100 and 101 is retained in the position of FIG. 2 by a lever 126 pivoted on the reinforcement 90 and provided at one end with a hook 129 adapted to co-operate with a pin 133 fast with each side plate 100, 101 by the action of a spring 130 stretched between each lever 126 and a fixed point of the reinforcement 90. The levers 126 are moreover provided with lugs 134.

Each of the side plates 100 and 101 is moreover provided with a positioning lever 145 pivoted on a pin 146, provided with a lug 147 at one end and adapted to co-operate, in the position of FIG. 2, with the shoulder 148 of the projection 95 or 96 to which it is adjacent. When the corresponding side plate 100 or or 101 is rotated 180° out of the sector on which it is mounted (FIG. 6), the same lug 147 is adapted to co-operate with the shoulder 150 of the same projection 95, 96 by the action of the spring 151 stretched between the other end of the lever 145 and a fixed point 152 of the side plate 100, 101. Finally, each of the side plates 100 and 101 is provided with a lug 153 adapted to co-operate with the shoulder 150 of the corresponding projection 95 or 96 in the position of FIG. 6.

The position of the drum 1 in FIG. 2 coincides with the rest position thereof. In order to effect the replacement of the reels 9 and 13, the following procedure is carried out the panel 155 (FIG. 1) of the body of the machine is removed and in this way access is obtained to the left-hand part, with reference to FIGS. 1 and 2, of the drum; the deveoping unit 20 is disconnected from the machine and, if necessary, cleaning thereof is carried out, and then the sector 5 is grasped at the sides and is pulled towards the outside of the machine until it reaches the withdrawn position of FIG. 6.

Then, by acting on the lugs 134 of the levers 126, the latter are disengaged from the pins 133 of each of the side plates and these plates are turned over through 180', anticlockwise in the case of the side plate 100 and clockwise in the case of the side plate 101; the side plates will be located stably in this position owing to the action of the lugs 147 of the positioning levers 145 and of the lugs 153, which abut against the shoulders 150 of the respective projections 95 and 96.

At this point, by acting on the lugs 125, the levers 115 are rotated in opposition to the action of the springs 118 and at the same time the pins 140 and 141 are disengaged from the respective recesses 121, thus removing the used reels 9 and 13.

Then, the pins 41 of a fresh feed reel 9 carrying a fresh band 7 of photosensitive material are positioned on the side plates 100, a portion of photosensitive band is unwound and passed over and around the outer periphery of the sector 5 and is finally wound around an empty take-up reel 13, being fixed thereto if necessary. Then the pins 140 of this reel 13 are positioned in the recesses 121 of the side plates 101. The pins 140 will remain fixed in the position of FIG. 6 by the action of the levers 115. Then by removing the positioning levers 145 of the side plates 100 and 101 in opposition to the action of the springs 151, the side plates 100 and 101 are turned over, being brought back into the position of FIG. 2 and being reengaged with the sector 5 by means of the levers 126.

By rotating both the reels manually in opposite directions, the band can be tensioned if it should not prove to be well tensioned.

At this point, the sector 5 is reclosed by causing the pins 78 to slide in the respective bushes 76 until they are brought back into the position of FIG. 2, the drum 1 is rotated manually through 180°, thus bringing the sector 6 into the same position in which the sector 5 was previously, and the abovedescribed reel-changing operations are repeated on the sector 6, after which the developing station 20 is refitted and the panel 155 is replaced, restoring the copying machine to the state of use.

The devices for the rotation of the drum 1 and for the feed of portions of band 7 and 8 from the feed reels 9 to the take-up reels 13 will now be described.

A gear 170 (FIG. 3) is keyed on the bush 67 of the drum 1. The drum 1 receives its rotary motion from a driving shaft 171 by means of a pinion 172 keyed on the shafts 171 and meshing with the gear 170. The driving shaft 171 receives its motion in known manner from a motor not shown in the drawing.

On each of the cores 138 of the take-up reels 13 there is keyed a respective gear 174. A gear 175 is pivoted on the spindle 68 inside the drum 1 and meshes with each gear 174. The gear 175 is provided with two slots 176 and 177 and with pins 178 and 179 fast with it.

On the spindle 68 there is keyed a gear 180 which is provided with pins 181 and 182 fast therewith and which can slide in the slots 176 and 177, respectively, of the gear 175. Two springs 183 and 184 are stretched between the pin 179 of the gear 175 and the pin 182 of the gear 180 and between the pin 178 of the gear 175 and the pin 181 of the gear 180, respectivey. The assembly of the gears 175, 180 and the springs 183, 184 constitutes in substance a flexible coupling in the transmisson of the motion from the gear 180 to the gear 175.

An "autolock" device 187 known per se pivoted on a pin 185 fast with the reinforcement 90 of the sector 6 also meshes with the gear 180.

On the spindle 68, but outside the drum, there is also keyed a gear 186.

A lever 188 (FIGS. 3 and 4) is pivoted on a pin 189 fast with the body of the machine. The lever 188 is provided at one end with a lug 191 adapted to co-operate with the teeth of the gear 186, and with a projection 195 having an inclined surface 197.

A lever 198 is pivoted on a pin 199 and bears at one end a lug 200 adapted to co-operate with the lug 191 of the lever 189 to hold it beyond the teeth of the gear 186 by the action of a spring 204 stretched between the lever 198 and the lever 188. The other end of the lever 198 is connected to the armature 201 of an electromagnet 203.

A lever 205 is pivoted to a pin 206 fast with an outer side wall of the body and carries a pin 207 at one end. The other end of the lever 205 is connected to the armature 208 of an electromagnet 209.

When the electromagnet 209 is energized, the pin 207 of the lever 205 is adapted to co-operate with the inclined surface 197 of the projection 195 of the lever 188, while with the electromagnet 209, deenergized the pin 207 is kept out of engagement with the inclined surface 197 by the action of a spring 210 stretched between the lever 205 and a fixed point of the body of the machine.

Figure 4:
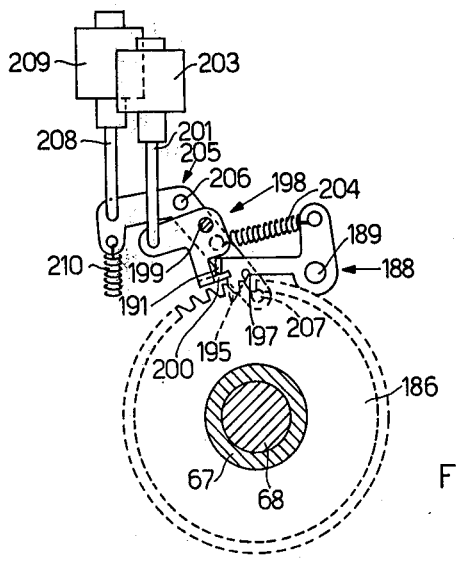
FIG. 4 is a section on the line IV—IV of the drum of FIG. 3.

In the inoperative state, with the electromagnets 203, 209 deenergized, the levers are in the position of FIG. 4.

Each of the feed reels 9 (FIG. 3) is provided with a gear 215 keyed on the respective core 138. A gear 216 is keyed on the spindle 69 inside the drum 1 and meshes with the gears 215.

A gear 217 is also keyed on the spindle 69, but outside the drum 1.

A bail lever 218 (FIGS. 3 and 5) is pivoted on the pin 219 fast with the side wall 73 of the drum 1 and outside the drum. The lever 218 has two arms 220 and 221. The end of the arm 221 is provided with a lug 222 adapted to co-operate with the teeth of the gear 217, and with a projection 223 the end of which is articulated to the end of an arm 225 of a bail lever 226 pivoted on a pin 227 fast with the side wall 73 of the drum 1 on the outside thereof and having a second arm 232 having at one end a projection 228 defining an inclined surface 229.

A spring 230 is stretched between the arm 232 of the lever 226 and the arm 220 of the lever 218.

Figure 5:
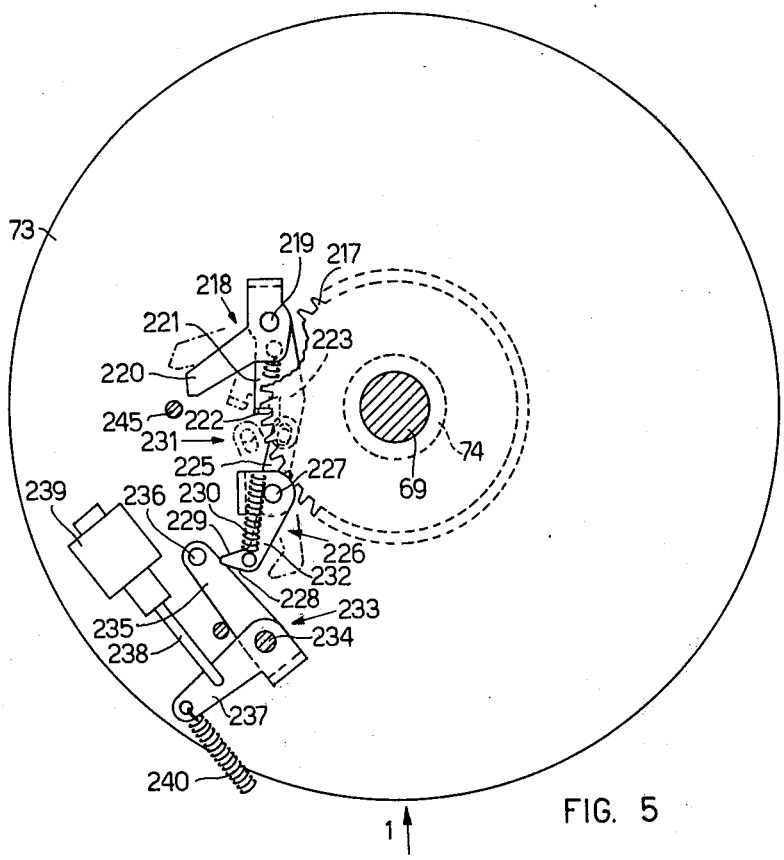
FIG. 5 is a section on the line V—V of the drum of FIG. 3.

The assembly of the bail levers 218 and 226 with the spring 230 constitutes a toggle lever system 231 transported by the drum 1 and having two stable positions, one of which, the rest position, is that shown in the drawing and the other is that in which the lever 226 is turned anticlockwise with respect to the position of the drawing, while the lever 218 is turned clockwise with respect to the position of the drawing until the lug 222 is disengaged from the gear 217, so that the toggle lever system 231 is in the position indicated by chain-dotted lines in FIG. 5.

A lever 233 is pivoted on a pin 234 fast with the frame 3 of the machine. The lever comprises a first arm 235 having a stud 236 at one end and a second arm 237 connected to the armature 238 of an electromagnet 239 fast with the frame 3 of the machine.

A spring 240 is stretched between the arm 237 and a fixed point of the frame in order to keep the stud 236 disengaged from the inclined surface 229 of the lever 226 when the electromagnet 239 is deenergized, while the energization of the electromagnet 239 produces clockwise rotation of the lever in opposition to the action of the spring 240 to engage the stud 236 with the inclined surface 229 and thus bring the toggle lever system into its disengaged stable position shown in chain-dotted lines in FIG. 5.

A pin 245 is fast with the side wall 71 of the body and is adapted to engage with the arm 220 of the lever 218 during the rotation of the drum when the toggle lever system 231 is in the position indicated in chain-dotted lines in FIG. 5 in order to bring the articulation 231 back into the rest position with the lug 222 in engagement with the teeth of the gear 217.

Besides the normal copying cycle, the machine is adapted to execute a band feed or advance cycle for changing the positions of the bands 7 and 8 on the periphery of the drum 1 during a complete revolution of the drum 1 itself.

To this end, the machine comprises a two-position switch 250 (FIG. 1) for prearranging the machine in the copying state or in the band feed state; in the latter state, all the copying stations 17, 18, 20, 25, 27, 29 and the conveying devices 48, 50, 51, 53, the fixing unit 52 and the optical scanning system 35 described above are deactivated.

The machine also comprises a second key 251 for starting the changing cycle.

As already described, under inoperative conditions the parts of the machine are in the positions indicated in the drawings and the drum is stationary.

For the execution of a band feed cycle, the switch 250 is prearranged in the position which corresponds to the state of the machine corresponding to this cycle and the cycle itself is started by pressing the key 251.

This last operation has the following immediate consequences:

The pulse energization of the electromagnet 203 which causes the clockwise rotation of the lever 198, disengaging its lug 200 from the lug 191 of the lever 189, as a result of which the lever 189 performs an anticlockwise rotation, owing to the action of the spring 204, until its lug 191 engages with the gear 186. In this way, the gear 186 is rendered fast with the side wall 70 of the body.

The pulse energization of the electromagnet 239, which causes the shifting of the articulation 231 of the toggle lever system 226, 218 into the position shown in chain-dotted lines in FIG. 5, so that the lug 222 of the lever 218 is disengaged from the gear 217, which thus remains disengaged from the drum 1.

The setting in rotation of the driving shaft 171, which transmits the rotational movement in the direction of the arrow (FIG. 2) to the drum 1 through the medium of the gears 172, 170.

During the rotation of the drum 1, since the gear 186 is stationary, any rotation of the spindle 68 on which this gear 186 is keyed is also prevented and, consequently, any substantial rotation of the gear 175 with respect to the gear 180 also keyed on this spindle 68.

Consequently, because of the rotation of the drum 1, there is a forced rotation of the gears 174 transported by the drum and fast with the take-up reels 13 in the direction indicated by the arrow, so that the take-up reels 13 take up band 7 and 8 from the respective feed reels 9.

The feed reels 9 give up band 7 and 8 inasmuch as the gears 215 fast with them mesh with the gears 216 keyed on the spindle 69, which is free to adopt any rotation, since as already stated the gear 217 fast with it is disengaged from the drum 1.

Therefore, under the pull imposed by the take-up reels, fresh portions of band 7 and 8 are unwound from the reels 9. The diameters of the gears 174, 175, 176 and 215, 216 are calculated so that whatever the state of filling of the take-up reel (and therefore its diameter) at least as much band 7 and 8 is changed in a 320° rotation of the drum 1 as is necessary for covering each of the sectors 5 and 6 with unused photosensitive material.

At about 40° from completion of a complete revolution of the drum 1, the arm 220 of the lever 218 encounters the pin 245 because of the position of the articulation 231 and, because of this, the articulation 231 is brought back into the position indicated in full lines and, consequently, the lug 222 of the lever 218 engages with the teeth of the gear 217 again, thus rendering the spindle 69 and the gears 217 and 216 fast with the drum.

From this moment, therefore, no relative rotation can take place between the drum 1 and the feed reels 9, so that the latter cease to unwind the bands 7 and 8.

In the last 40° of rotation, therefore, the pull of the take-up reels 13 on the bands 7 and 8 will cause them to be stretched over the periphery of the sectors 5 and 6 and, in the event of excessive pull, which could cause tearing of the band, there is a slip between the gears 175 and 180, with consequent tensioning of the springs 183 and 184.

At the end of a complete revolution of 360°, the drum 1 stops and the cycle terminates with the pulse energization of the electromagnet 209, which causes the clockwise rotation of the lever 205, so that the pin 207 of the said lever co-operates with the inclined surface 197 of the projection 195 to cause the lever 188 to turn clockwise and bring the lug 191 back out of the teeth of the gear 186 and, by the action of the spring 204, the lug 200 of the lever 198 below the lug 191, so that at the end of the energization of the electromagnet 209 all is restored to the conditions of FIG. 4 with the gear 186 disengaged from the body.

After this operation, the machine is adapted to resume the normal copying cycle, during which the autoclock device 187 prevents any rotation of the gear 180 such as to cause a slackening of the tension of the bands 7 and 8.

A change which can be made in the machine described heretofore is that of prearranging the copying staions adjacent the periphery of the drum or of limiting the angular amplitude of the sectors 5 and 6 so that none of these has to be disconnected from the machine to effect the replacement of the reels 9 and 13.

Another variant of the machine may be that consisting of rendering the sectors 5 and 6 movable with respect to the remainder of the drum 1 by pivoting to the fixed sectors, instead of causing them to slide by means of the guides.

It is understood that the present invention is not limited to the above-described embodiment, in which the drum 1 is divided into only two movable sectors. Another variant may, in fact, be to divide the drum into a number of movable sectors greater than two, each provided with its own take-up reel 13 and feed reel 9, each provided with guides adapted to slide in bushes 75, 76 formed in a hub 2 of the above-described type and in which each take-up reel is fast with a gear 174 and each feed reel is fast with a gear 215 for co-operating with a matrix changing device of the above-described type.

In any case, the need to disconnect the developing unit must not be regarded as a disadvantage, since it is normally necessary to effect the cleaning of this unit periodically and therefore this can be done in coincidence with the changing of reels.

It is understood that other variations may be made in the apparatus hereinbefore described without thereby departing from the scope of the invention as hereinafter claimed.

What I claim is:

1. An electrophotographic copying machine comprising:

a photoconductor drum assembly having:

A rotary member mounted to the machine frame for rotation about an axis, a plurality of sector members. each having an arcuate support surface constituting part of the cylindrical periphery of the drum, each of said sector members being mounted on said rotary member, slidable in a direction perpendicular to the said axis between a first position in which it defines the respective part of the cylindrical periphery of the drum, and a second position into which it is shifted radially outward with respect to the remainder of the cylindrical periphery, a photoconductive element carried by each of said sector members, each photoconductive element comprising a web which extends between a feed station and a take-up station of the associated sector members with an intermediate portion of the web wound around the said support surface, and reversible locking means for maintaining the said sector members in the first position during the rotation of the drum about the said axis.

2. A machine according to claim 1, wherein each of the said take-up and feed stations comprises a feed reel and a take-up reel respectively mounted rotatably on reel suoports pivoted internally to the respective sector member, each take-up reel and the associated feed reel being in the proximity of the angular ends thereof, and that the said reel supports are adapted to be turned over towards the outside of the respective sector member when the respective sector member is in the said second position.

3. A machine according to claim 2, wherein each of the said reels is fast with a pin and each of the said reel supports comprises a pair of side plates and means fast with the said side plates for supporting the ends of the said pin removably and rotatably.

4. A machine according to claim 1, wherein a plurality of selectively actuable devices are disposed around and adjacent the periphery of the drum assembly and adapted to perform the individual stages of charging, exposure, development, transfer and cleaning of an electrophotographic copying process, and further comprising means for rotating the drum assembly about said axis so as to bring the photoconductive elements cyclically under the action of the said devices, first selectively actuable means for pre-arranging a first machine state in which the said devices are activated and normal copying cycles are executed during the rotation of the drum assembly and second selectively actuable means for pre-arranging a second machine state in which a cycle of changing the portions of photoconductive web wound around the said support surface is effected during the rotation of the drum assembly.

5. A machine according to claim 4, further comprising feeding means activated in the said second machine state by said second pre-arranging means, for simultaneously feeding portions of each photoconductive web from the respective feed reel through the support surface to the corresponding take-up reel during a revolution of the drum assembly about its own axis.

6. A machine according to claim 5, wherein the said feeding means comprise first gears fast and coaxial with each of the said take-up reels, a second gear mounted rotatably around said axis and coupled with the said first gears, and second locking means activated by the said second pre-arranging means for locking the rotation of the said second gear during a predetermined rotation of the drum assembly.

7. A machine according to claim 6, wherein the said second locking means co-operate with the said second gear with a flexible torsion coupling interposed.

8. A machine according to claim 6, further comprising third locking means for locking the rotation of each feed reel and means for activating said third locking means in said second machine state after a first fraction of the said predetermined rotation, in which portions of web are unwound from the said feed reels, has been effected, whereby during the remaining fraction of the said predetermined rotation following the said first fraction said web portions are tensioned over the said support surfaces of the said sector members.

* * * * *

UNITED STATES PATENT AND TRADEMARK OFFICE

CERTIFICATE OF CORRECTION

PATENT NO. : 4,057,343

DATED : November 8, 1977

INVENTOR(S) : Piero Gontero

It is certified that error appears in the above-identified patent and that said Letters Patent are hereby corrected as shown below:

Column 2, line 33, "respectivey" should be --respectively--;

Column 3, line 46, "120'" should be --120°--;

Column 4, line 5, "directon" should be --direction--;

Column 4, line 16, "respectivey" should be --respectively--;

Column 4, line 45, after "rotated", insert --through--;

Column 4, line 57, after "out", add a colon;

Column 4, line 60, "deveoping" should be --developing--;

Column 4, line 68, "180'" should be --180°--;

Column 5, line 11, "41" should be --141--;

Column 5, line 34, "abovedescribed" should be --above-described--;

Column 5, lines 43-44, "on the shafts" should be --on this shaft--;

Column 5, line 58, "respectivey" should be --respectively--;

UNITED STATES PATENT AND TRADEMARK OFFICE

CERTIFICATE OF CORRECTION

PATENT NO. : 4,057,343

DATED : November 8, 1977

INVENTOR(S) : Piero Gontero

It is certified that error appears in the above-identified patent and that said Letters Patent are hereby corrected as shown below:

Column 5, line 60, "transmisson" should be --transmission--;

Column 8, line 37, "clock device" should be --lock device--;

Column 8, line 42, "staions" should be --stations--;

Column 9, line 31, "suoports" should be --supports--.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*